US007565722B2

(12) United States Patent
Kusayama et al.

(10) Patent No.: US 7,565,722 B2
(45) Date of Patent: Jul. 28, 2009

(54) TOP END STOPS FOR SLIDE FASTENER

(75) Inventors: Masahiro Kusayama, Toyama-ken (JP); Satoshi Matsumoto, Toyama-ken (JP); Ryo Tanaka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 185 days.

(21) Appl. No.: 11/404,004

(22) Filed: Apr. 13, 2006

(65) Prior Publication Data

US 2006/0236510 A1 Oct. 26, 2006

(30) Foreign Application Priority Data

Apr. 20, 2005 (JP) ..... 2005-122377

(51) Int. Cl.
*A44B 19/36* (2006.01)

(52) U.S. Cl. ..... 24/436; 24/388; 24/433

(58) Field of Classification Search ..... 24/436, 24/433, 387, 388
See application file for complete search history.

(56) References Cited

U.S. PATENT DOCUMENTS 4,109,349 A * 8/1978 Tanaka ..... 24/436
4,232,431 A * 11/1980 Akashi ..... 24/388
4,447,936 A * 5/1984 Kusayama ..... 24/433
4,524,493 A 6/1985 Inamura
4,667,377 A * 5/1987 Akashi et al. ..... 24/436
6,112,376 A * 9/2000 Akashi et al. ..... 24/433
6,519,826 B1 * 2/2003 Ortlieb ..... 29/410
6,715,187 B1 4/2004 Wang
6,775,885 B1 * 8/2004 Wang ..... 24/385
2002/0050031 A1 * 5/2002 Takasawa et al. ..... 24/433

FOREIGN PATENT DOCUMENTS

EP 1029456 8/2000
JP 63-13689 4/1988

* cited by examiner

*Primary Examiner*—Robert J Sandy
(74) *Attorney, Agent, or Firm*—Alston & Bird LLP

(57) ABSTRACT

Various embodiments of top end stops for a slide fastener are made of resin and are each formed adjacent to an end portion of each of two rows of coupling elements provided along edge portions of a pair of fastener tapes. Each of the top end stops has a concave portion on an opposed face to the other top end stop, and each of the concave portions accomodate a slider therebetween when the slide fastener is colsed. A gap is formed between each top end stop and a coupling element disposed at the end portion of each row of the coupling elements, and an overlapping portion is formed in a bottom end of one of the top end stops, such that a coupling head of a mating coupling element is capable of overlapping the overlapping portion.

11 Claims, 8 Drawing Sheets

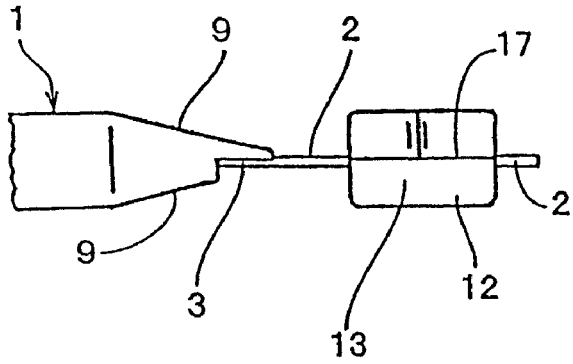
FIG. 9
PRIOR ART
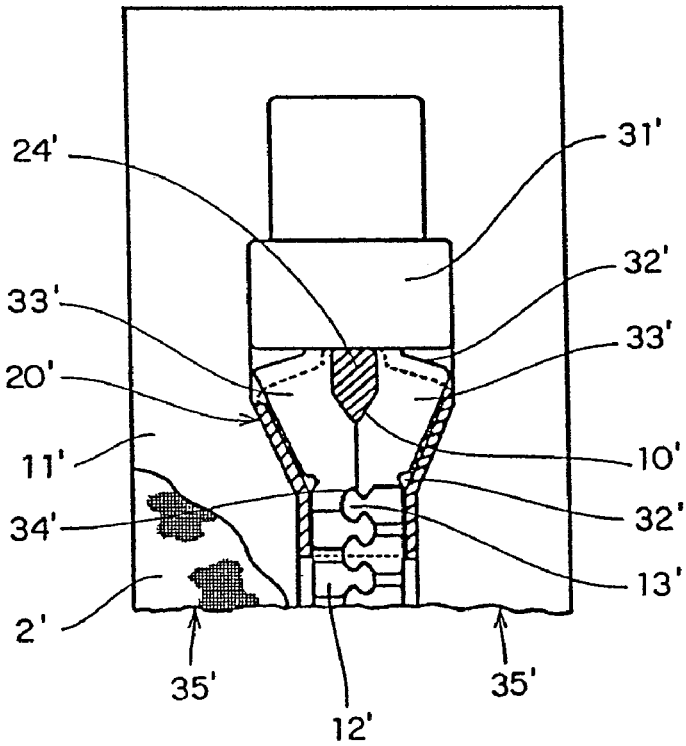

TOP END STOPS FOR SLIDE FASTENER

BACKGROUND OF THE INVENTION

1. Field of the Invention

The present invention relates to atop end stop of a fastener chain, the fastener chain comprising coupling elements each of which formed of a single body of resin.

2. Description of the Related Art

Conventionally, for example, according to Japanese Utility Model Application Publication No. 63-13689, there have been fastener stringers 35', in which a coating layer 11' composed of elastomer such as rubber is provided on both front and rear surfaces of each of fastener tapes 2' and the coupling elements 12', fins made of the same material as that of the coating layer 11' are provided between the respective coupling elements 12' at edge portions of the fastener tapes 2', and the fastener stringers 35' are integrally connected to each other by a locking block 31' at end portions of coupling element rows of the right and left fastener stringers 35'. In such fastener stringers 35', the coupling elements 12' and the locking block 31' are connected through sealing bodies 33', and front ends of the sealing bodies 33' are integrally connected to the locking block 31'. A window hole 10' in which a diamond 24' of a slider 20' can be fit is provided between the sealing bodies 33', each of the seal bodies 33' and a first coupling element 12' are provided so as to be adjacent to each other, and then, one of the sealing bodies 33' is provided with a notch portion 34' to which a coupling head 13' of a mating coupling element 12' can be fit. Further, bent portions of the fastener stringers 35' are provided with notch grooves 32', so that a slide fastener can be equipped with waterproof property as shown in FIG. 9.

Because the slide fastener shown in FIG. 9 comprises the elastomer coating layer 11' provided on the surface of the fastener tape 2', the fastener tape 2' itself is provided with rigidity so that it is difficult to handle such a fastener tape. Further, because the front ends of the sealing bodies 33' are integrally connected to the locking block 31', inconveniently, the front ends of the fastener chain cannot be opened. Additionally, a portion in which the locking block 31' and the sealing body 33' are connected and a portion in which the sealing body 33' and the first coupling element 12' are connected need to be provided with notch grooves 32' for securing plasticity, respectively. Thus, the processing for forming the notch grooves 32' is very troublesome, which is a problem to be solved.

SUMMARY OF THE INVENTION

The present invention has been accomplished by solving the above-described problems. A main object of the invention is to provide top end stops for a slide fastener which allow a front end of a fastener chain to be opened to prevent occurrence of wrinkles in a fastener tape by a diamond of a slider, and which allows a coupling element and a top end stop to overlap each other easily, so that right and left fastener stringers are arranged neatly, thereby facilitating the handling of the fastener tape, and a single top end stop is processed by injection molding.

In addition to the above object, it is another object of the invention is to provide top end stop for a slide fastener in which a portion in the fastener chain where the top end stop and the coupling element overlap each other is provided on the fastener tape, and the overlapping portion is formed so as to be thinner than other portions, thereby achieving a presentable and accurate overlapping.

In addition, another object of the invention is to provide top end stops for a slide fastener achieving an accurate overlapping in which a portion of the top end stop where the top end stop and the coupling element overlap each other is formed on both front and rear surfaces of the top end stop, or on a same plane as a face of an engaging protrusion formed at a neck portion of the coupling element, or a same plane as a coupling face provided on the coupling element.

Another object of the invention is to provide top end stops for a slide fastener in which, in order to stop the slider having an automatic stop mechanism at the fastener chain, a locking portion is formed next to the overlapping portion provided in the fastener chain, thereby achieving an accurate stopping of the slider.

Further, another object of the invention is to provide top end stops for a slide fastener in which a notch portion is formed on an edge portion of the fastener tape in order to prevent wrinkle by the diamond of the slider and the top end stop is molded on the notch portion, thereby securing a fastener tape having an excellent appearance.

Finally, another object of the invention is to provide top end stops for a slide fastener in which the top end stops are formed so as to surround the diamond of the slider such that the fastener tape located at a forward end with respect to the top end stop in the fastener chain is sealed hermetically, thereby securing a slide fastener having an excellent appearance and some extent of waterproof property and airtight performance.

In order to achieve the above-described object, according to a main aspect of the present invention, there is provided top end stops for a slide fastener, in which each of the top end stops made of thermoplastic resin is molded into a separate rectangular piece at an end portion of a row of coupling elements provided along an edge portion of each of a pair of fastener tapes, such that each top end stop is adjacent to the coupling elements, and the top end stop has a concave portion which escapes from a diamond of a slider, and a gap is formed between the top end stop and a coupling element disposed at the end portion of the row of the coupling elements, and an overlapping portion with which a mating coupling element is capable of overlapping is formed in a bottom end of one of the top end stops.

As for the effects of the present invention, each of the top end stops formed on the fastener chain is molded into a separate rectangular piece with a gap from the end portion of the rows of the coupling elements provided along the edge portion of each of the pair of fastener tapes, so that the fastener chain is very easy to handle and the plasticity of the fastener chain is not lost. Further, because the top end stop is formed into the concave portion which escapes from the diamond of the slider, no wrinkle occurs in the fastener tape so as to maintain an excellent appearance. Moreover, because the overlapping portion which overlaps with the coupling element is provided in a portion, where a bottom end stop of one of the top end stops is extended to a side of the coupling element, and the coupling head of the coupling element projects to overlap with the overlapping portion, the overlapping can be carried out effectively without any collision of the coupling head.

Preferably, the overlapping portion provided in the top end stop is provided on one of the fastener tapes and overlaps with the coupling head of the coupling element, and the overlapping portion is thinner than other portions of the top end stop.

Consequently, the gap between the top end stop provided with the overlapping portion and the coupling element at the end portion can be formed small. In addition, because the overlapping portion is thinner than the other portions of the top end stop, the overlapping can be achieved securely.

In addition, it is preferable that the overlapping portion provided in the top end stop is formed on both front and rear surfaces of the fastener tape, so that the overlapping portion can overlap with both the front and rear faces of the coupling element.

Consequently, the overlapping portions are formed on both faces of the top end stop, thereby providing the top end stops for the slide fastener comprising the overlapping portions having a good balance and appearance.

Alternately, the overlapping portion in the top end stop is formed on a same plane as a face of an engaging protrusion formed at a neck portion of a single body coupling element, so that the overlapping portion can overlap with both the front and rear faces of the coupling element.

Consequently, the overlapping operation can be carried out smoothly, and there could be achieved top end stops for the slide fastener comprising the overlapping portion suitable for the coupling element having the same configuration in the front and rear faces and including a fitting groove which is fitted to the engaging protrusion at the front end of the coupling head.

Alternately, the overlapping portion in the top end stop is formed on a same plane as a coupling face formed on the coupling head of a single body coupling element, so that the overlapping portion can overlap with any side of the front and rear faces of the coupling element.

Consequently, the overlapping operation can be carried out smoothly. In addition, if the front and rear surfaces of the coupling element are different, there could be achieved top end stops for the slide fastener comprising an overlapping portion suitable for a coupling element in which the shape of the front half portion of one face is circular while the shape of the front half portion of the other face is of an elongated triangle.

Preferably, a recess which allows a locking pawl of an automatic stop mechanism of the slider, the recess provided in the top end stop, to be operated to be enter therein and to be restricted is provided at a portion next to the overlapping portion formed in the top end stop.

Consequently, the slide fastener equipped with the automatic stop mechanism incorporates the overlapping portion, so that the stop function can be activated securely.

Further, it is preferable that the top end stop provided on the fastener tape is molded with resin so as to cover a notch portion formed by cutting out the edge portion of the fastener tape. Consequently, no wrinkle or tightening phenomenon is induced by the slider equipped on the fastener chain.

More preferably, the top end stop provided on the fastener tape is provided with a notch portion and is formed into a concave portion which surrounds the diamond of the slider.

Consequently, the edge portion at the terminal end of the fastener chain is sealed with the top end stop, thereby finishing a slide fastener having an excellent appearance.

As mentioned above, the effects achieved by the invention are extremely remarkable.

BRIEF DESCRIPTION OF THE DRAWINGS

FIG. 8 is a side view of a fastener stringer at one of the top end stops.

FIG. 9 is a front view of a well known top end stop for a slide fastener.

DESCRIPTION OF THE PREFERRED EMBODIMENTS

Figure 1:
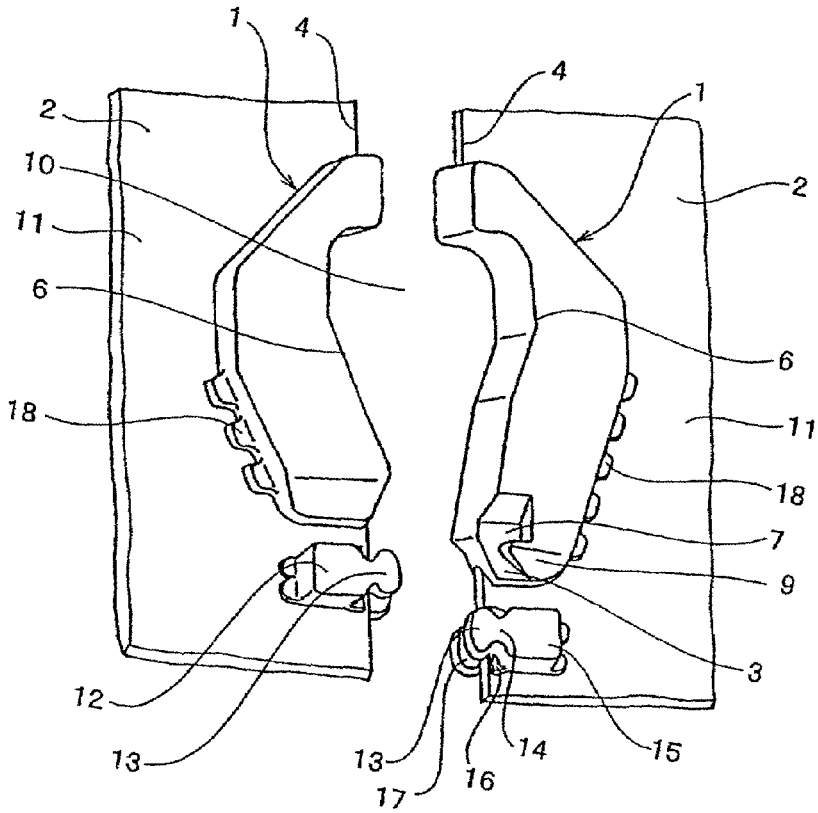
FIG. 1 is a perspective view of tope end stops for a slide fastener top according to a first embodiment of the invention.

In top end stops for a slide fastener of the invention, coating layers 11 are formed by coating both front and rear surfaces of fastener tapes 2 with synthetic rubber or thermoplastic elastomer, and coupling elements 12 each composed of a single body are molded on an edge portion 4 of one side edge of each of the fastener tape 2 by using thermoplastic resin so as to form a fastener chain. The coupling elements 12 mounted on the fastener chain are partly removed to provide a space portion in each of the fastener tapes. By cutting out a portion corresponding to a top end stop 1 of the edge portion 4 of the fastener tape 2 in the space portion, a notch portion 5 is formed, and then, the top end stop 1 is formed on the notch portion 5 by injection molding using thermoplastic resin.

Figure 2:
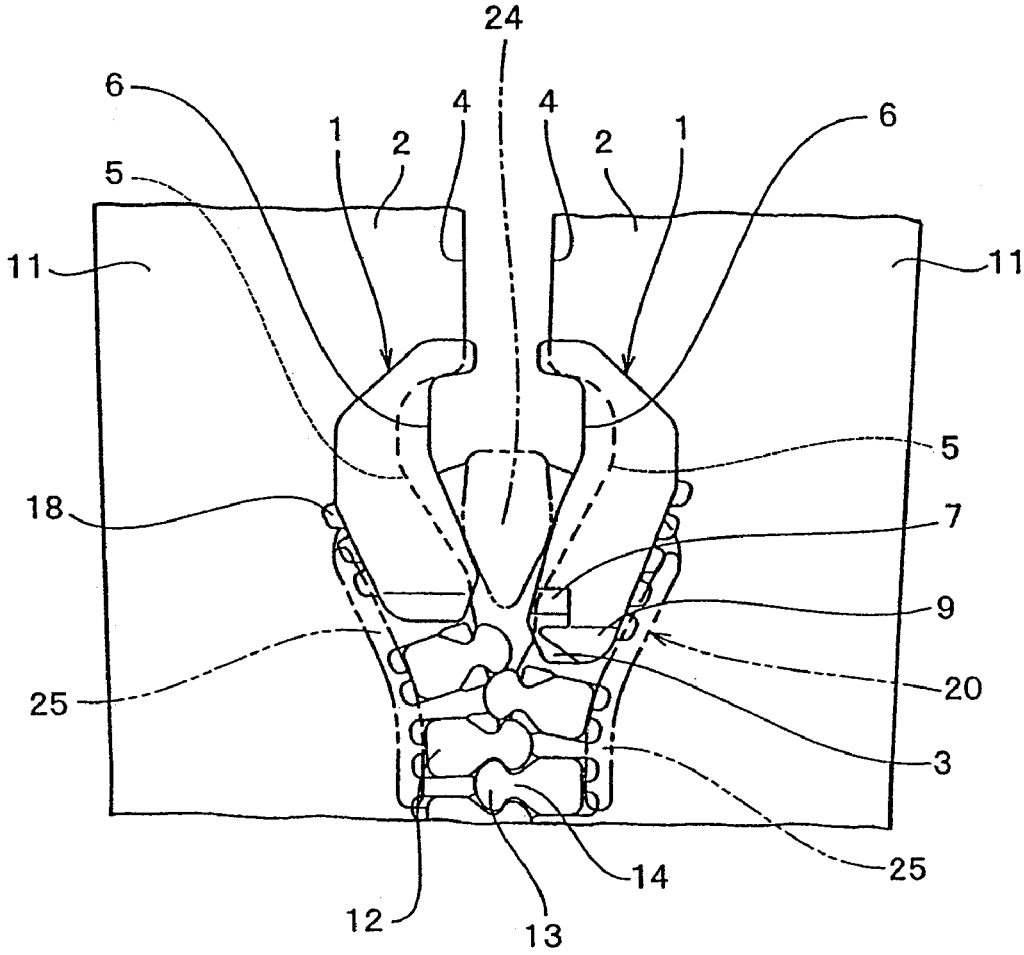
FIG. 2 is a front view showing a state just before the top end stops are closed.

As shown in FIG. 2, each of the top end stops 1 is formed by injection molding along the notch portion 5 provided in the space portion of the fastener tape 2 by use of the same kind of the thermoplastic resin as the coupling element 12 such that the top end stop 1 is provided next to the coupling elements 12. Each of the top end stop 1 is formed in a shape of a rectangular piece, an accommodation portion 10 capable of accommodating a diamond 24 of a slider 20 is provided in the middle of the top end stops 1 by benting front end portions of the top end stops 1 in a shape of a hook, and the right and left front end portions of the top end stops 1 are formed so as to surround the diamond 24 of the slider 20. A bottom end of one of the top end stops 1 is extended to a side of the coupling elements 12, and in the surface of the extended portion, an overlapping portion 3 is formed with which a coupling face 17 of a coupling head 13 in a mating coupling element 12, that is, the coupling face 17 which engages an engaging protrusion 16 formed on a neck portion 14 is capable of overlapping.

The overlapping portion 3 is provided on a side of a side edge of a slope portion 9 formed on the bottom end of the top end stop 1. The overlapping portion 3 has a flat overlapping face, which is formed on a substantially same plane as a surface of the engaging protrusion 16 protruding in a back and forth direction of the fastener chain, the overlapping portion 3 has a thickness corresponding to a thickness of the fastener tape 2, the engaging protrusion 16 formed on the neck portion 14 of the coupling element 12 mounted on the edge portion 4 of a mating fastener tape 2. The overlapping portion 3 performs a same function as that of the engaging protrusion 16 provided on the neck portion 14 of the single body coupling element 12. A recess 7 is formed inside the overlapping portion 3, namely, on a side of the front end of the top end stop 1, in order to accommodate a front end of a locking pawl 27 of an automatic stop mechanism 26 of the slider 20 to stop sliding of the slider 20. Further, fin portions 18 are formed at an appropriate interval on the external periphery of each of the top end stops 1 such that they project on the fastener tape 2 in order to fix the top end stop 1 to the fastener tape 2 firmly.

First Embodiment

Figure 3:
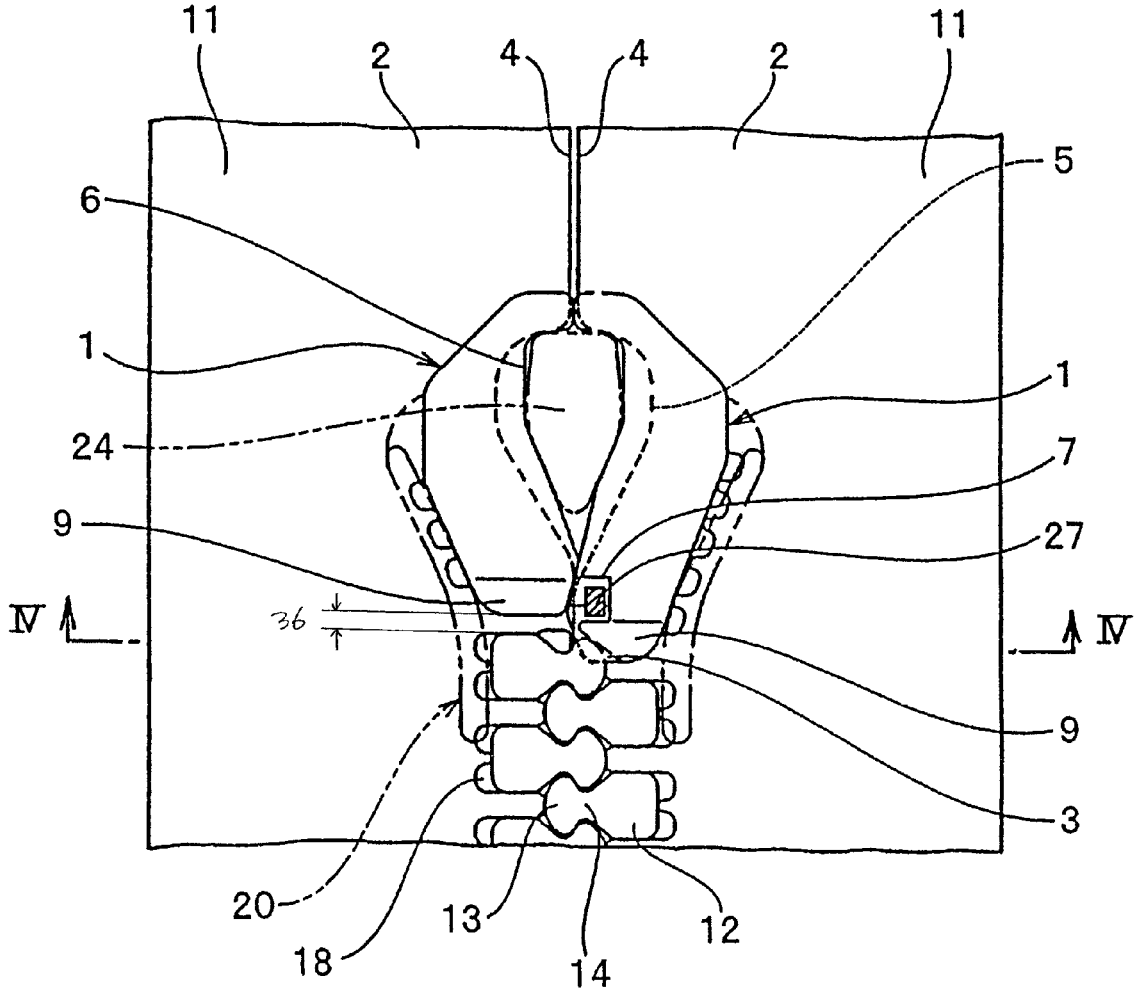
FIG. 3 is a front view showing a state in which the top end stops are closed completely.

Top end stops for a slide fastener of the invention will be described. In the top end stops for the slide fastener according to a first embodiment of the invention shown in FIGS. 1 to 5, coating layers 11 are formed by coating both front and rear surfaces of each of the fastener tapes 2 in a fastener chain with synthetic rubber or thermoplastic elastomer so as to provide the fastener tapes 2 with waterproof property or water cutoff performance. Edge portions 4 of the fastener tapes 2 closely contact with each other, when the fastener is closed. A notch portion 5 having a substantially same size as that of the top end stop 1 is formed in the fastener tape 2 in order to form the top end stop 1 in an edge portion 4 of a side edge of the fastener tape 2, and the top end stop 1 is molded by injection molding by using the notch portion 5 with polyamide, polyacetal, polypropylene, polyethylene terephthalate or the like. Each of the top end stops 1 entirely provides a hook shape, and its right or left front end is bent inward to form an accommodating portion 10 capable of accommodating a diamond 24 of a slider 20 in the middle of the top end stops. A concave portion 6 is formed in the middle of the top end stop 1 into a concave shape dented toward an inside of the fastener tape along the notch portion 5. When the right and left top end stops 1 are positioned face-to-face after the faster is closed, an accommodation portion 10 capable of accommodating the diamond 24 is formed by the concave portions 6. Further, the concave portions 6 are formed so as to escape from the diamond 24 and it means that the concave portions escape from the diamond 24 such that end portions of the fastener tapes 2 on the side of the top end stops are in the parallel condition with respect to each other when the fastener is closed. As shown in FIGS. 2 and 3, the notch portion 5 is formed in the edge portion 4 of the fastener tape 2 such that it is dented toward an inside of the fastener tape 2 at an end portion of a row of the coupling elements 12.

Each of the coupling elements 12 forms, in the edge portion 4 of the fastener tape 2, the coupling head 13, the neck portion 14, the body portion 15, and the engaging protrusion 16 symmetrically on the front and rear surfaces of the fastener tape 2, which are connected through a through hole (not shown) of the fastener tape 2. As for the concrete configuration, the coupling head 13 for coupling; the body portion 15 which is formed continuously from the coupling head 13 through the neck portion 14 and is wider than the neck portion in the longitudinal direction; the engaging protrusion 16 having a wing shape and extending in a right and left direction over the neck portion 14 and the body portion 15; and the coupling face 17 overlapping the engaging protrusion 16 when the coupling head 13 is coupled with the mating coupling element 12, are formed. The coupling face 17 is formed on the side where the front and rear coupling heads 13 face each other. When the coupling elements 12 are coupled with each other, the coupling head 13 is positioned on the fastener tape 2 of the other side and overlaps on the engaging protrusion 16 of the other side.

Figure 4:
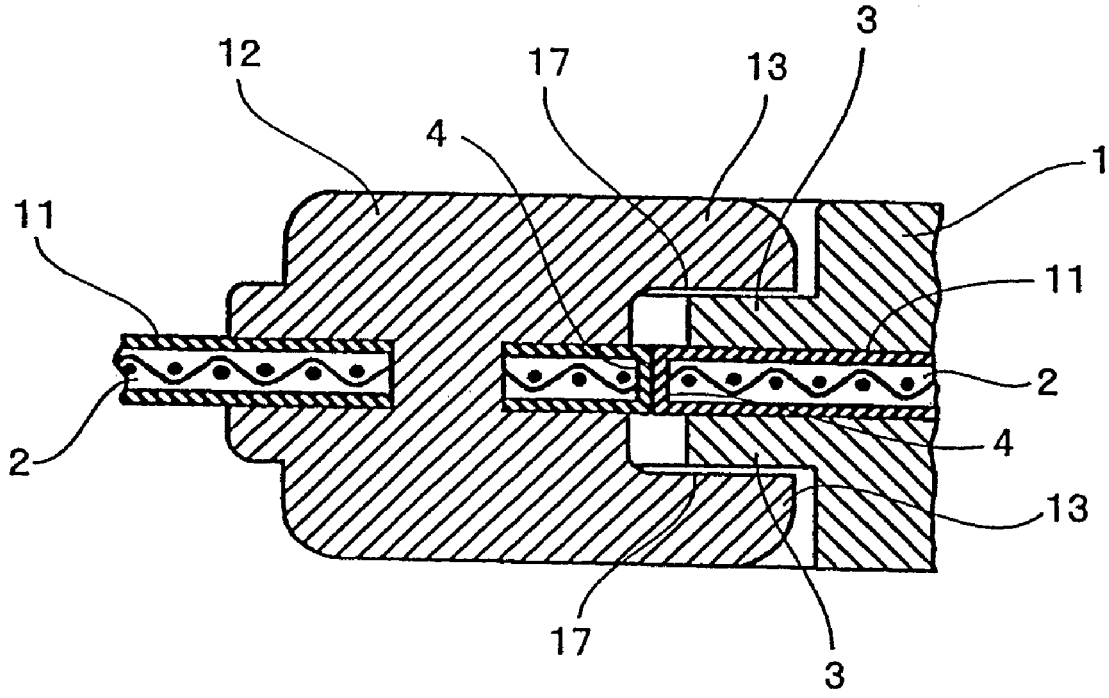
FIG. 4 is a sectional view of the top end stop taken along the line IV-IV in FIG. 3.

A bottom end of one of the top end stops 1 is extended to the side of the coupling elements 12, a slope portion 9 is formed in the extended portion, and on part of this extended slope portion 9, that is, a slope portion 9 on a side of the edge portion 4 of the top end stop 1, an overlapping portion 3 is formed on each of both surfaces of the fastener tape, the overlapping portion having a same thickness as that of an engaging protrusion 16 provided at the front end of the mating coupling element 12. The overlapping portions 3 formed in one of the top end stops is formed on a coupling element 12 side on the adjoining fastener tape 2, and the coupling face 17 of the other side overlaps the overlapping portion 3 and the engaging protrusion 16 on a side of the top end stop I having the overlapping portion 3. In the overlapping portion 3, as shown in FIG. 4, the edge portion 4 on the side edge of the fastener tape 2 is projected sideways compared with a mounting portion of the coupling element so as to obtain specified waterproof property and water cutoff performance. Because the top end stops 1 are pulled by flanges 25 of the slider 20 so as to surround the diamond 24, the top end stops 1 also secure waterproof property and water cutoff performance as compared with a conventional slanting top end stop.

The overlapping portions 3 are provided such that the surface of each of the slope portions 9 is flat on the edge portion 4 of the slope portion 9, the slope portions formed on both the front and rear faces of the top end stop 1, so that upper and lower coupling faces 17 of the coupling element 12 can engage overlappingly. The size of the overlapping portion 3 may be of any one as long as it allows the coupling face 17 of the coupling element 12 to engage therewith. Further, the fin portions 18 are provided at an appropriate interval on the external peripheries of the top end stops 1, and the fin portions 18 make contact with the upper and lower flanges 25 of the slider 20, thereby allowing the slider 20 to slide freely. Alternately, leg portions, which project from the body portion 15 of the coupling element 12 and are equivalent of the fin portions 18 in the thickness, can be formed so as to exert the same effect of the fin portions 18.

Figure 5:
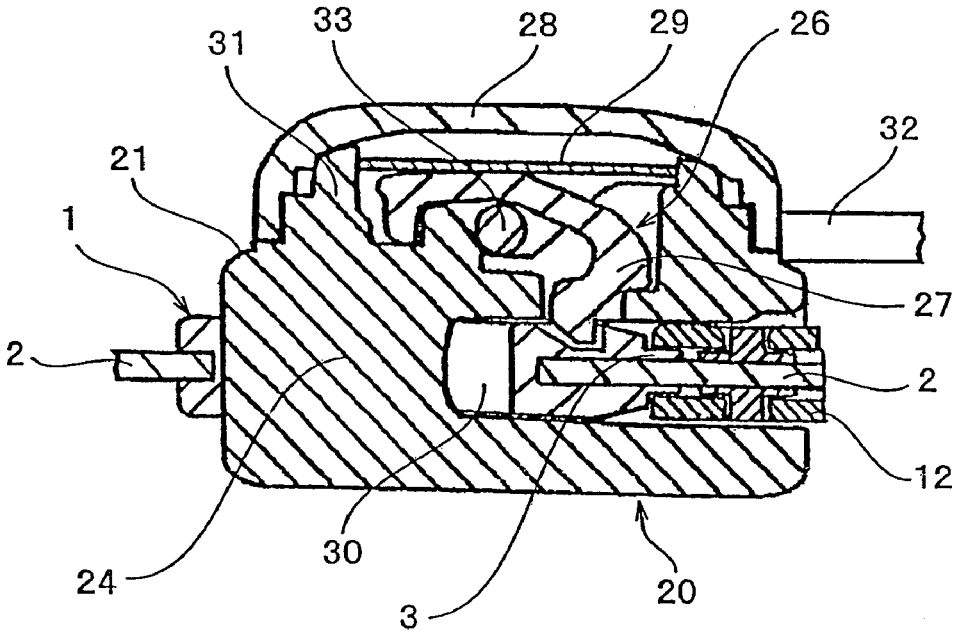
FIG. 5 is a longitudinal sectional view of a slider at the top end stops.

The top end stop 1 contains a recess 7, which is capable of accommodating a front end of a locking pawl 27 of an automatic stop mechanism 26 provided on the slider 20, next to the overlapping portion 3 on the front surface, the recess 7 being provided on a front face side of one of the top end stops 1. Depending on the configuration of the slider 20, the recesses 7 may be provided on both the front and rear surfaces of the top end stop 1. In the slider 20 having the automatic stop mechanism 26, as one example, the locking pawl 27 having a bent shape is incorporated in part of a body 21 in a contacting condition with a leaf-like spring 29, as shown in FIG. 5, and the front end of the locking pawi 27 is always projected into a guide groove 30 in the body 21. A pivoting shaft 33 of a pull tab 32 is supported in a middle of the locking pawl 27 so as to lift up the locking pawl 27 when required. In the meantime, the spring 29 is attached to an attaching post 31 of the body 21, and its top face is covered with a cover 28 attached to the body 21.

The use condition of the top end stops for the slide fastener will be explained. The slider 20 is slid to a side of the top end stops 1 to close the right and left coupling elements 12, and finally, the top end stops 1 are pulled by the slider so as to accommodate the diamond 24 into the accommodating portion 10 of the top end stops 1, thereby finishing the closing operation of the slider 20. At this time, the locking pawl 27 of the automatic stop mechanism 26 incorporated in the slider 20 projects into the guide groove 30 provided in the top end stop 1, and then advances into the recess 7 and stops. As to the other coupling element 12, the coupling faces 17 of the coupling heads 13 make contact with the overlapping portions 3 provided on the top end stop 1 from both front and rear faces so as to hold the slider 20. As for the holding state of the slider 20, the fastener tape 2 generates no wrinkles by the slider 20 differently from a conventional article in which the top end stop 1 is opened in a slanted shape to produce wrinkles, thereby closing the top end stop 1 neatly. Further, in order to prevent the top end stops from being the slanted shape, as shown in FIG. 3, when the slider 20 is slid in the closing direction, the coupling elements 12 completely engage with each other, so that the mating coupling element 12 invades into a gap 36 between the top end stop 1 forming the overlapping portion 3 and the coupling element 12. If the gap 36 is widened in order to avoid a collision with the top end stop 1, the top end stop may fluctuate. However, because the slider collides with the coupling element 12 if the gap 36 is reduced, the overlapping portion 3 which is thinner than the other top end stop 1 is provided to reduce the gap 36 thereby preventing any collision with the coupling element. As for the overlapping portion 3 thinner than the other top end stop 1, the top end stop 1 has a portion which has the same thickness of the coupling element 12 and passes through the inner portion of the slider 20, and the overlapping portion 3 in the coupled condition enters between the coupling heads 13 formed on front and rear faces of the fastener tape 2 and is capable of overlapping the coupling face 17. Further, as shown in FIG. 3, in the condition that the overlapping portion 3 is coupled, the right and left top end stops are paralleled.

Second Embodiment

Figure 6:
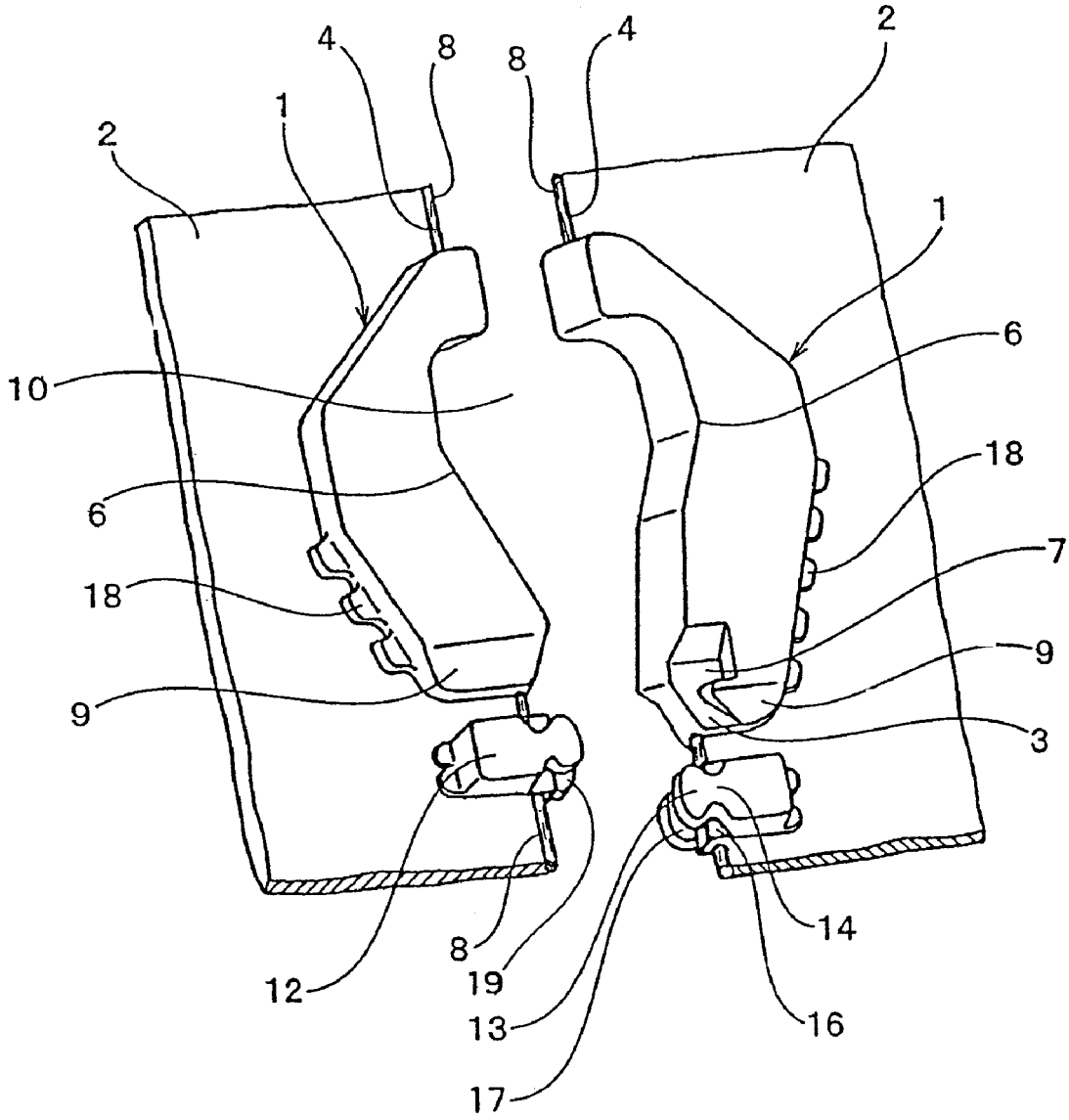
FIG. 6 is a perspective view of top end stops for a slide fastener according to a second embodiment of the invention.

Top end stops for a slide fastener according to a second embodiment of the invention shown in FIG. 6 will be described. Top end stops 1 in a fastener chain are formed so as to have the same configuration as that of the top end stops 1 of the first embodiment. The second embodiment is different from the first embodiment only in that no coating layer 11 is provided on any of front and rear surfaces of a fastener tape 2. The fastener tape 2 is formed by weaving or knitting, and a swelling core thread 8 is woven or knitted into an edge portion 4 on the side edge of the fastener tape 2 so as to swell the edge portion. A concave fitting groove 19 having the same thickness as that of an engaging protrusion 16 of a coupling element 12 can be fitted to an overlapping portion 3 formed at a bottom end of the top end stop 1. A front end of the overlapping portion 3 projects sideways compared with the edge portion 4 of the fastener tape 2, so that upper and lower coupling faces 17 of the fitting groove 19 formed in the coupling element 12 can make contact and overlap with the overlapping portion 3. The size of the overlapping portion 3 may be of any size as long as the coupling faces 17 of the fitting groove 19 in the coupling element 12 can engage.

Third Embodiment

Figure 7:
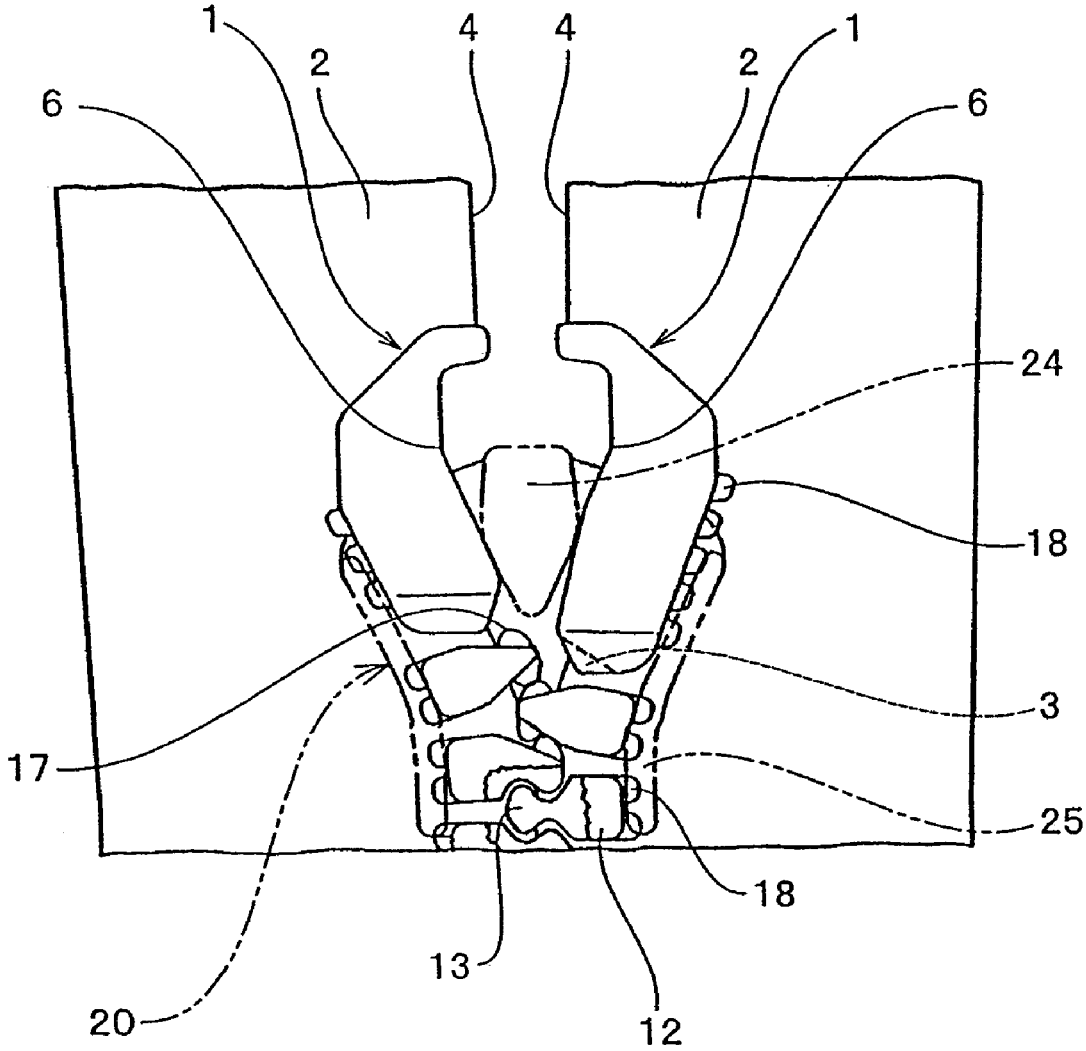
FIG. 7 is a partially broken front view of top end stops for a slide fastener according to a third embodiment of the invention.

Top end stops for a slide fastener according to a third embodiment of the invention shown in FIGS. 7 and 8 will be explained. The top end stops 1 in a fastener chain of this embodiment is largely different from those of the above embodiments in that an overlapping portion 3 is provided only on a side of the rear surface of the fastener chain, although the appearance of the top end stops is substantially the same as that of the top end stops of the above embodiments. As for shapes in front and rear sides of a coupling element 12 which can use the overlapping portion 3, for example, the shape of a front half portion of the coupling element 12 on the front surface is formed into an elongated triangle while the shape of the front half portion on the rear surface is formed into a round head shape, i.e., a gourd shape, so that the coupling element 12 engages through a round-head-shaped coupling face 17 on the rear surface. Therefore, the overlapping portion 3 is provided on the rear side of the fastener chain, and the round-head-shaped coupling face 17 of the coupling element 12 overlaps the overlapping portion 3. In the meantime, when a slider 20 having an automatic stop mechanism 26 is used, a recess 7 may be provided in the surface of the top end stop 1 so as to allow the locking pawl 27 to project into a gap between the coupling elements 12 or (to project) with respect to the recess 7, thereby stopping the slider.

The top end stops for the slide fastener of the invention are used in an opening of clothes, bags and the like, and at the end portions of the fastener chain, the top end stops are separated completely when the fastener chain is closed with a slider. Because the top end stops surround the diamond by means of the flanges of the slider to prevent wrinkle from occurring in the fastener tape, the top end stops have a great deal of potential.

What is claimed is:

1. Top end stops for a slide fastener, comprising a first top end stop and a second top end stop, wherein each top end stop is made of resin, and said first top end stop is molded at an end portion of a first row of coupling elements provided along an edge portion of a first fastener tape such that said first top end stop is adjacent to an end coupling element in said first row of coupling elements, and said second top end stop is molded at an end portion of a second row of coupling elements provided along an edge portion of a second fastener tape such that said second top end stop is adjacent to an end coupling element in said second row of coupling elements, and each top end stop has a concave portion on an opposed face to the other top end stop, each of the concave portions for accommodating a slider therebetween when the slide fastener is closed, wherein a first gap is formed between the first top end stop and the end coupling element of the first row of coupling elements and a second gap is formed between the second top end stop and the end coupling element of the second row of coupling elements, and an overlapping portion is formed on a side edge side in a bottom end of the first top end stop so as to have a thickness approximate to a thickness of an engaging protrusion of a neck portion of a coupling element in the second row of coupling elements, wherein a coupling head of the end coupling element in the second row of coupling elements is capable of overlapping the overlapping portion when the slider is accommodated between the concave portions of the top end stops.

2. The top end stops for the slide fastener according to claim 1, wherein the overlapping portion overlaps with the coupling head, and the overlapping portion is thinner than other portions of the first top end stop.

3. The top end stops for the slide fastener according to claim 1, wherein the coupling head is formed on each of both front and rear surfaces of one of the fastener tapes, and the overlapping portion is also formed on each of both front and rear surfaces of the first fastener tape so as to overlap with the coupling head.

4. The top end stops for the slide fastener according to claim 1, wherein the coupling element comprises a coupling head, a neck portion, a body portion, and an engaging protrusion which are formed symmetrically on each of front and rear faces of the fastener tape, coupling faces are formed on opposite faces of coupling heads on the front and rear faces of the fastener tapes, the coupling faces are positioned on front and rear faces of a mating fastener tape in a coupled condition, the top end stops are separable in right and left directions, respectively, the bottom end of the first top end stop is protruded compared with another the bottom end of the second top end stop, the overlapping portion with which the coupling head of the end coupling element of the second row of coupling elements is capable of overlapping is formed in the bottom end which is protruded, and the coupling faces can overlap the overlapping portion.

5. The top end stops for the slide fastener according to claim 4, wherein the fastener tapes form, on both front and rear faces of each fastener tape, coating layers comprised of synthetic rubber or thermoplastic elastomer, and edge portions of the fastener tapes closely contact with each other.

6. The top end stops for the slide fastener according to claim 1, wherein the overlapping portion is formed on a same plane as a face of an engaging protrusion formed at a neck portion of a single body coupling element.

7. The top end stops for the slide fastener according to claim 1, wherein the overlapping portion is formed on a same plane as a coupling face of the coupling head of a single body coupling element.

8. The top end stops for the slide fastener according to claim 1, wherein a recess for accommodating a front end of a locking pawl of an automatic stop mechanism in the slider is formed next to the overlapping portion.

9. The top end stops for the slide fastener according to claim 1, wherein the top end stops are molded with resin so as to cover a notch portion formed on the edge portion of each of the fastener tapes.

10. The top end stops for the slide fastener according to claim 1, wherein the top end stops are each provided with a notch portion formed on the edge portion of the respective fastener tape and each notch portion is formed into a concave portion which surrounds the diamond of the slider.

11. The top end stops for the slide fastener according to claim 1, wherein each of the concave portions is formed such that there is a clearance in a part between the concave portion and the slider when the slider is accommodated.

* * * * *